US008661690B2

(12) United States Patent
Murphy et al.

(10) Patent No.: US 8,661,690 B2
(45) Date of Patent: Mar. 4, 2014

(54) SCISSORS AND SHARPENING ARRANGEMENT

(75) Inventors: Rosemary Murphy, North Rocks (AU); Clive Solari, Paddington (AU)

(73) Assignee: McPherson's Limited, Mulgrave (AU)

( * ) Notice: Subject to any disclaimer, the term of this patent is extended or adjusted under 35 U.S.C. 154(b) by 232 days.

(21) Appl. No.: 13/124,821

(22) PCT Filed: Oct. 15, 2009

(86) PCT No.: PCT/AU2009/001353

§ 371 (c)(1),
(2), (4) Date: Aug. 17, 2011

(87) PCT Pub. No.: WO2010/042984

PCT Pub. Date: Apr. 22, 2010

(65) Prior Publication Data

US 2011/0289782 A1 Dec. 1, 2011

(30) Foreign Application Priority Data

Oct. 16, 2008 (AU) ..... 2008905370

(51) Int. Cl.
*B26B 13/28* (2006.01)
*B24D 15/06* (2006.01)

(52) U.S. Cl.
USPC ..... 30/138; 30/254; 30/261; 30/266; 76/82.2

(58) Field of Classification Search
USPC ..... 30/122, 138, 254, 255, 256, 261, 262, 30/266, 268; 76/82.2
See application file for complete search history.

(56) References Cited

U.S. PATENT DOCUMENTS

| | | | | | |
|---|---|---|---|---|---|
| 348,749 | A | * | 9/1886 | Kimbler | 7/131 |
| 1,051,333 | A | * | 1/1913 | Jacoby | 76/82.2 |
| 1,963,422 | A | * | 6/1934 | Scott | 76/82.2 |
| 2,794,250 | A | * | 6/1957 | Bethune | 30/254 |
| 4,258,592 | A | * | 3/1981 | Linden | 76/82.2 |
| 4,279,076 | A | | 7/1981 | Jackson | |
| 4,348,809 | A | | 9/1982 | Jackson | |

(Continued)

OTHER PUBLICATIONS

International Search Report dated Dec. 24, 2009 for International Application No. PCT/AU2009/001353 (4 pages).

*Primary Examiner* — Hwei C Payer
(74) *Attorney, Agent, or Firm* — Hovey Williams LLP

(57) ABSTRACT

The invention relates to scissors and a sharpening device. The scissors include two blades, each blade having a cutting edge and a back edge which respectively form opposite longitudinal edges of the blade. A pivot connects the two blades for relative movement of the blades between an open condition in which the cutting edge of each blade are apart and a closed condition in which each blade are substantially adjacent and the back edge of each blade projects beyond the cutting edge of the other blade. The blades also include a sharpening condition in which the cutting edge of each of the blades can be sharpened. A biasing means is included for biasing the blades away from the sharpening condition towards the closed condition and/or the open condition. The sharpening device is for scissors including two blades having a cutting edge. The sharpening device includes a hollow housing for receiving the blades of the scissors, a pair of positioning units within the housing arranged in an opposed relationship to receive the blades therebetween when the scissors are inserted into the housing, and a pair of sharpener units located within the housing arranged in an opposed relationship to contact the blades therebetween.

13 Claims, 5 Drawing Sheets

(56) References Cited

U.S. PATENT DOCUMENTS

| | | | | |
|---|---|---|---|---|
| 4,495,696 | A * | 1/1985 | Fethke et al. | 30/138 |
| 4,528,707 | A * | 7/1985 | Aida | 7/131 |
| 4,825,544 | A * | 5/1989 | Petroff | 30/138 |
| 5,001,945 | A * | 3/1991 | Lindeen | 76/82.2 |
| 7,607,231 | B2 * | 10/2009 | Klecker et al. | 30/236 |
| 2004/0000058 | A1 * | 1/2004 | Shyr | 30/262 |
| 2007/0193037 | A1 | 8/2007 | Tsuda | |

* cited by examiner

SCISSORS AND SHARPENING ARRANGEMENT

RELATED APPLICATIONS

This application is a national stage submission under 35 U.S.C. 371 of International Patent Application No. PCT/AU2009/001353, filed Oct. 15, 2009, which claims the priority of Australian Patent Application No. 2008905370, filed Oct. 16, 2008, both of which are hereby incorporated by reference in their entirety.

FIELD OF THE INVENTION

The present invention relates to two bladed cutting implements of the kind having a pair of pivotally connected blades which will be hereinafter identified generally as scissors. It should be understood that this term includes all cutting implements of this type including shears, clippers, pruners and the like.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Most scissors have a closed condition in which the back edge of the blades of the scissors projects beyond the cutting edge of the other cutting blade of the scissors. The cutting edge is therefore not exposed, protecting the blade against damage and users from accidentally contacting the sharp cutting edge of the blade. However, scissors of this configuration are difficult to sharpen, as the blades must be physically separated and sharpened individually.

U.S. Pat. Nos. 4,279,076 and 4,348,809 provide an alternate scissor construction and associated sharpening arrangement which permits the two blades to be sharpened simultaneously while the scissors are in a closed condition. Each of the blades of the scissors has a cutting edge and a back edge which respectively form opposite longitudinal edges of the blade. In the closed condition of the scissors, the cutting edge of each blade is level with or projects beyond the back edge of the other the blade. The blades can therefore be sharpened simultaneously using a sharpening arrangement having two opposing sharpener units that sharpen the cutting edge of each blade when the blades pass between the sharpener units. However, this arrangement can lead to users accidentally contacting the sharp surface of the cutting edge of the blade when the scissors are in the closed condition.

It would therefore be desirable to provide an alternate scissors configuration which each blade can be sharpened simultaneously but also substantially protects a user from accidentally contacting the sharp surface of the cutting edge of the blade when the scissors are in a closed condition.

SUMMARY OF THE INVENTION

According to a first aspect of the present invention, there is provided scissors including:

two blades, each blade having a cutting edge and a back edge which respectively form opposite longitudinal edges of the blade;

a pivot connecting the two blades for relative movement of the blades between an open condition in which the cutting edge of each blade are apart; a closed condition in which each blade are substantially adjacent and the back edge of each blade projects beyond the cutting edge of the other blade; and a sharpening condition in which the cutting edge of each of the blades can be sharpened; and a biasing means for biasing the blades away from the sharpening condition towards the closed condition and/or the open condition.

The biasing means keeps the cutting edge of the blades from being exposed for sharpening unless the blades are deliberately moved into the sharpening condition. This means that in normal usage the blades are biased for use between the open and closed positions, thus reducing the danger of a user touching the cutting edges of the blades.

The sharpening condition of the scissors place the blades in a position in which the blades can be sharpened. This position is generally dictated by the configuration of sharpening device in which the scissors are intended to cooperate. For example, the sharpening device could be configured to sharpen the cutting edge with the blades positioned between the open and closed condition. Alternatively, the sharpening device could be configured to sharpen the cutting edge of the blade when that cutting edge is level with or projects beyond the back edge of the other blade. The sharpening condition of the blades would correspond to those positions. In the second case, the biasing means keeps the cutting edge of the blades from overlapping the back edge of the blades unless the blades are deliberately moved into the sharpening condition, for example when handles of the scissors are tightly squeezed closed.

The biasing means moves the blades away from the sharpening condition towards the closed and/or open condition. Preferably, the blades are biased to a rest position in which the cutting edges of the blades are not exposed to a user. This can be achieved by configuring the biasing means to bias the blades away from the sharpening condition to the closed condition.

The biasing means can be any suitable resilient and/or flexible member for example a spring such as a leaf spring, coil spring, or a resilient body such as a rubber or other elastomeric member. The biasing means is generally located in a position that operatively associates, and preferably operatively connects the two blades of the scissors. In one embodiment, the biasing means is located in or proximate the pivot means. In some forms this results in the pivot means being fixedly secured into a first blade, allowing the biasing means to act between the pivot means and the other (second) blade. Preferably, this type of pivot means includes a pivot shaft laterally connecting the blades. This pivot shaft has a first end having a keyed fit with the first blade and a second end configured to allow the second blade to pivot about the shaft relative to the first blade. In some embodiments, a slot is provided in the second end of the shaft into which a first section of a biasing means such as a leaf spring can be secured. A second section of the biasing means can then be secured in at least one adjoining recess in the second blade.

In another form, the biasing means is secured to the pivot so as to act between the two blades. Preferably the biasing means is a helical torsion spring. In this form the helical spring acts between the two blades to bias the blades from the sharpening condition to the closed condition.

Each blade is typically operatively associated with a handle which allows a user to actuate the blades between the open, closed and sharpening conditions. The handles can be any hand or finger graspable member or formation configured to be spaced apart in the open and closed condition and to be proximate or abutting in the sharpening condition. Preferably, the handles are spaced a short distance apart when the blades are in the closed condition.

According to a second aspect of the present invention, there is provided a sharpening device for scissors including two blades having a cutting edge, the sharpening device including:

- a hollow housing for receiving the blades of the scissors;
- a pair of positioning units within the housing arranged in an opposed relationship to receive the blades therebetween when the scissors are inserted into the housing; and
- a pair of sharpener units located within the housing arranged in an opposed relationship to contact the blades therebetween.

In this aspect, the present invention provides a device that sharpens both blades of a pair of scissors in a single operation. When the scissors are pushed into the housing, they are guided by positioning units which space the blades away from the sharpener units. To sharpen the cutting edge of the blades, the blades must be moved into contact with the sharpening unit, for example by squeezing the handles of the scissors together. This brings the blades into contact with the sharpening unit and sharpens the blades as the cutting edge is passed over the sharpener units. This can occur when for example the blades are pulled out of the housing. If the blades of the scissors are not moved to contact at least one of the sharpener units whilst pulling the blades out of the housing, sharpening does not take place.

Again, the configuration of the sharpening device complements the configuration of scissors that the device is intended to be used in conjunction.

In one form, the sharpener units are positioned outwardly of the positioning units in a position in which the sharpener units can only contact and remove material from the cutting edge of the blade upon passing the blades between the sharpener units when the cutting edge of the blades of the scissors are moved to contact at least one of the sharpener units.

In one particular embodiment, the associated scissors include blades having a cutting edge and a back edge which respectively form opposite longitudinal edges of the blade. Each of the blades is movable to a position in which the cutting edge of each blade projects beyond the back edge of the other blade. Here, the sharpener units of the device only contact and remove material from the cutting edge of the blade upon passing the blades between the sharpener units when the cutting edge of the blades of the scissors are moved beyond the back edge to contact at least one of the sharpener units. In a preferred embodiment, the sharpening device of the second aspect is configured for scissors according to the first aspect of the present invention. Here, the sharpener units are only able to contact and remove material from the cutting edge of the blade upon passing the blades between the sharpener units when the blades of the scissors are in the sharpening condition.

The positioning units preferably include rollers positioned to contact the rear edge and/or cutting edge of the blades when the scissors are inserted into the housing. Each of the rollers can include an annular channel in which the rear edge and/or cutting edge of the blades are received. However, it is to be understood the other forms of positioning units such a Teflon, polymeric or other material blocks, sleeves or the similar could equally be used.

The sharpening device is preferably used to sharpen the whole cutting edge of the blades of a pair of scissors. This can be achieved by locating the positioning units and sharpener units adjacent an open front end of the housing. The sharpening device can be configured to sharpen the blades of the scissors during any movement of the blades relative to the sharpener units. Preferably, the sharpener units are configured to contact and remove material from the cutting edge of the blade upon removal of the scissors from the housing when the scissors are in the sharpening condition. The sharpener units can include any suitable sharpening surface for contacting and removing material from the cutting edge of the blade. Preferably, the sharpener units include a carbide sharpening surface. In one form, the sharpener units are pivotally mounted within the housing and are engaged by scissors so that upon removal of the scissors from the housing when in the sharpening condition the sharpener units pivot to contact and remove material from the cutting edge of the blade.

In some embodiments, the positioning units and sharpener units are mounted on carrier members located within the housing. Preferably, two opposing carrier members are provided in the housing. Each carrier member is preferably elongate and extends from a pivot connecting the two carrier members to its respective sharpener unit. Each carrier member is also preferably arranged in an opposed relationship to receive the blades therebetween. At least one carrier member is pivotable relative to the other carrier member. Preferably, a pivot is provided in the housing for connecting the two carrier members. A carrier member biasing means such as a coil spring or leaf spring(s) can be used to bias the carrier members towards each other within the housing. The carrier members therefore tend to squeeze the positioning units onto an edge, typically the back edge of the blades of the scissors when the scissors are inserted into the housing in a normal resting condition (and where the scissors are not in the sharpening condition). The member biasing means can be located in any location that can actuate the carrier members together. Preferably, the member biasing means is located at or adjacent the pivot connecting the two carrier members and/or located between the housing and the carrier members.

In some embodiments, the housing can be formed as a scabbard to protect the blades of the scissors when the scissors are not in use.

According to a third aspect of the present invention, there is provided a scissors and sharpening device including:

- scissors according to the first aspect of the present invention; and
- a sharpening device including:
- a hollow housing for receiving the blades of the scissors;
- a pair of positioning units within the housing arranged in an opposed relationship to receive the blades therebetween when the scissors are inserted into the housing; and
- a pair of sharpener units located within the housing arranged in an opposed relationship to contact the blades therebetween,
- wherein the sharpener units are positioned outwardly of the positioning units in a position in which the sharpener units can only contact and remove material from the cutting edge of the blade upon passing the blades between the sharpener units when the blades of the scissors are in the sharpening condition.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

Figure 1:
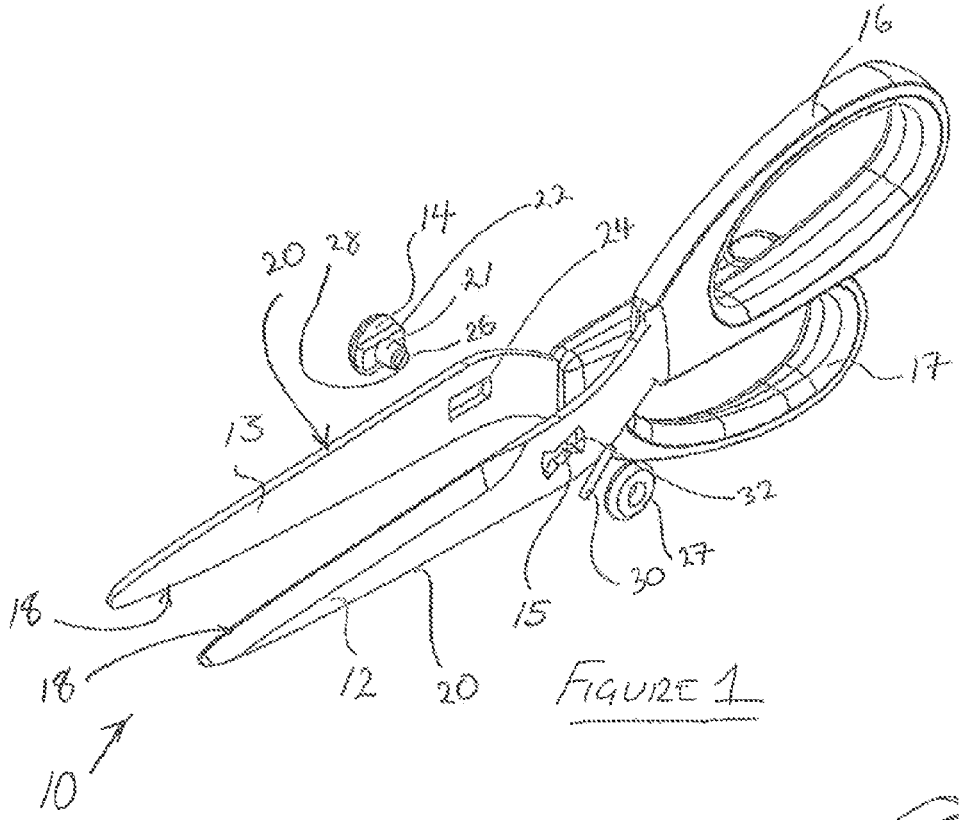
FIG. 1 is an exploded perspective view of a pair of scissors according to one preferred embodiment of the present invention.
Figure 2:
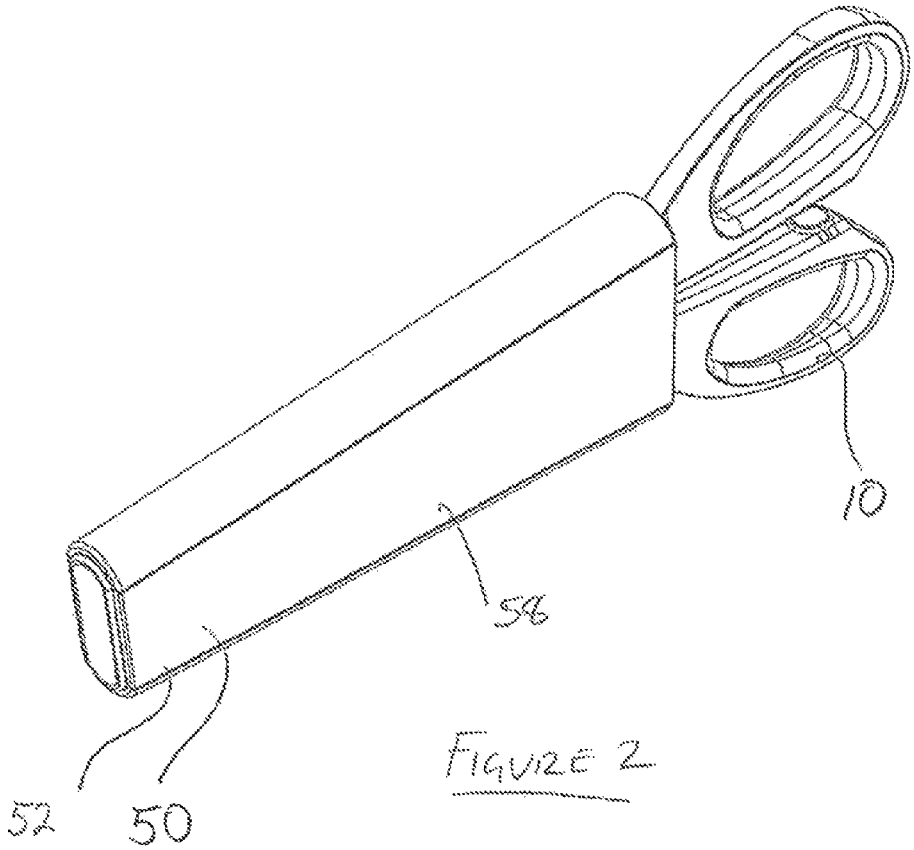
FIG. 2 is a perspective view of the scissors shown in FIG. 1 held in a scabbard that includes a sharpening device according to one preferred embodiment of the present invention.

Referring firstly to FIG. 1, there is shown a pair of scissors 10 according to one embodiment of the present invention. The scissors 10 include two elongate blades 12, 13 that have a cutting edge 18 and a back edge 20. Each blade 12, 13 includes a longitudinally integral handle 16, 17 which can be manipulated by the hand(s) of a user to move the blades 12, 13 about a pivot 15.

The blades 12, 13 of the scissors 10 are pivotally connected through a rivet 14 located at the pivot 15 so that the scissors 10 can be opened and closed. The rivet 14 includes a pivot shaft 21 that laterally connects the blades 12, 13. The rivet 14 has a first end which includes a rectangular lug 22 having a keyed fit within a rectangular opening 24 in the first blade 13. The shaft 22 of the rivet 14 has a threaded end 26 for receiving and securing an associated rivet cap 27.

In one form of the scissors 10, as shown in FIG. 1, the threaded end 26 also includes a slot 28 in which a central section of a biasing means in the form of a leaf spring 30 can be secured. The ends of the leaf spring 30 are secured within an adjoining recess 32 in the second blade 12. This arrangement results in the rivet 14 being fixedly secured within the first blade 13, and allows the leaf spring 30 to act between the rivet 14 and the other blade 12. The leaf spring 30 is configured to bias the blades 12, 13 from a sharpening condition to a closed condition as detailed below.

It is to be appreciated that any other form of biasing means and not just the leaf spring 30 could be incorporated in the pivotal connection of the blades 12, 13 of the scissors 10 and be suitable for the purpose of biasing the blades 12, 13 from a sharpening condition to a closed condition as detailed below.

Figure 1A:
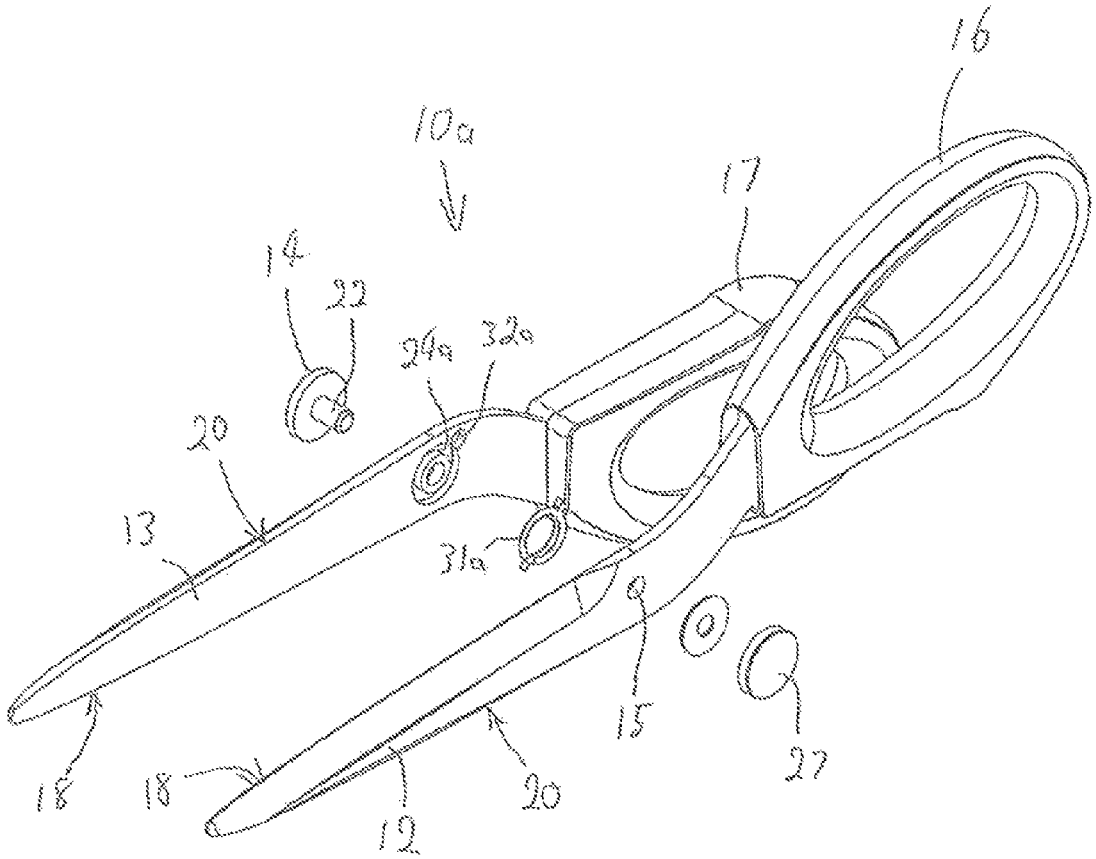
FIG. 1A is an exploded perspective view of a pair of scissors according to another preferred embodiment of the present invention.

Another embodiment of the scissors 10*a* shown in FIG. 1A has a similar construction to the scissors 10 of FIG. 1. Accordingly, like parts in the scissors 10*a* shown in FIG. 1A have been given the same reference numerals as like parts in the scissors 10 shown in FIG. 1 with the exception of the biasing means being in the form of a helical torsion spring 30*a* instead of the leaf spring 30 of FIG. 1. The helical torsion spring 30*a* is mounted to the shaft 22 of the rivet 14 and fits within an annular opening 24*a* in the first blade 13 and a like annular opening (not shown) in the second blade 12. The ends of the helical spring 30*a* are secured within an adjoining recess 32*a* in the first blade 13 and in recess (not shown) in the second blade 12. This arrangement results in the rivet 14 being fixedly secured within the first blade 13, and allows the helical spring 30*a* to act between the two blades 12, 13 to bias the blades 12, 13 from a sharpening condition to a closed condition as detailed below.

The blades 12, 13 of the scissor 10 can be moved between three separate conditions about the pivot 15.

For normal cutting operations the handles 16, 17 of the scissors 10 can be actuated to move the blades 12, 13 between an open condition (not illustrated in the figures) in which the cutting edge 18 of each blade 12, 13 are spaced apart, and a closed condition (best shown in FIG. 4) in which each blade 12, 13 are substantially adjacent and the back edge 20 of each blade 12, 13 projects beyond the cutting edge 18 of the other blade 13, 12 by a distance $\alpha$. This means that in normal usage, the cutting edges 18 of the blades 12, 13 are not exposed to a user as leaf spring 30 holds the blades 12, 13 in the closed condition.

When sharpening the cutting edges 18 of the blades 12, 13, the blades 12, 13 are moved from the closed condition (FIG. 4) to a sharpening condition (best shown in FIG. 5) in which the cutting edge 18 of each blade 12, 13 projects beyond the back edge 20 of the other blade 13, 12. In the illustrated embodiment, the midline of each blade 12, 13 are separated by distance $\beta$.

In the open condition, the handles 16, 17 of the scissors 10 are opened to a spaced apart condition in order to move the blades 12, 13 apart about the pivot 15.

Figure 4:
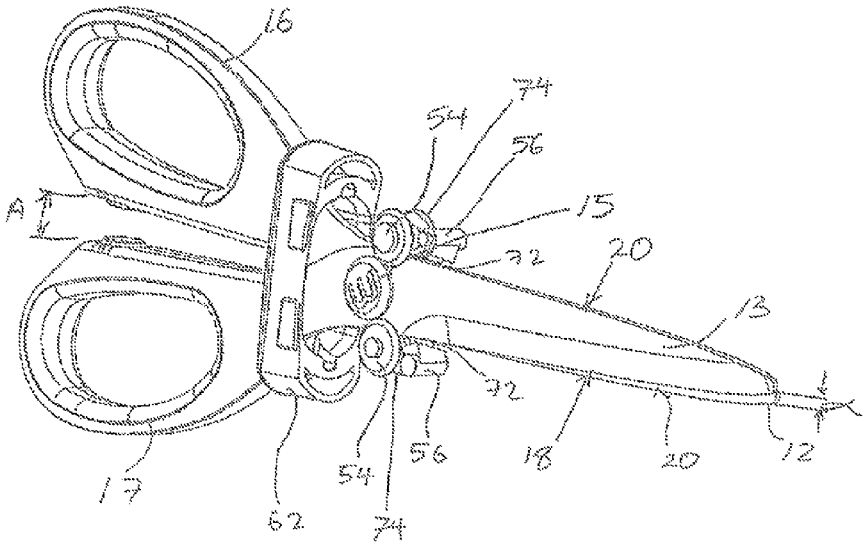
FIG. 4 is a perspective view of the scissors of FIG. 1 within the sharpening device with the blades configured in a closed (non-sharpening) condition.
Figure 5:
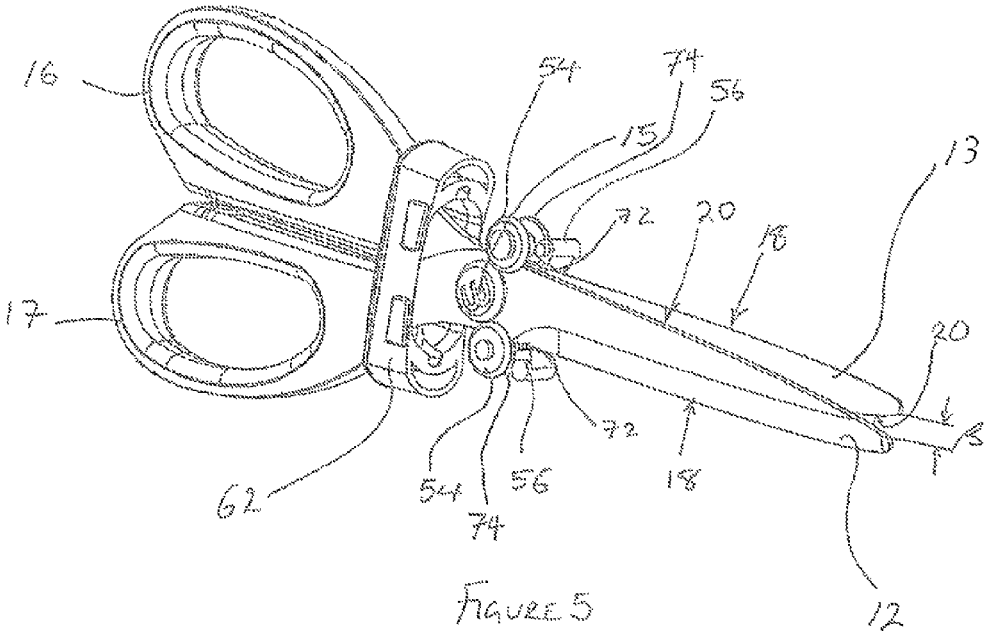
FIG. 5 is a perspective view of the scissors of FIG. 1 within the sharpening device with the blades moved to a sharpening condition.

In the closed condition (FIG. 4), the handles 16, 17 are held a short distance apart (distance A in FIG. 4) through the bias provided by the leaf spring 30. The leaf spring 30 also biases the blades 12, 13 away from the sharpening condition to the closed condition. The leaf spring 30 therefore keeps the cutting edges 18 of the blades 12, 13 from being exposed for sharpening unless the blades 12, 13 are deliberately moved into the sharpening condition. The handles 16, 17 must be squeezed together to overcome the bias provided by the leaf spring 30 and move the blades 12, 13 to the sharpening condition (FIG. 5).

Scissors 10 of the kind described can be produced in any appropriate manner.

A sharpening device 50 according to the present invention is shown in FIGS. 2 to 5. The illustrated sharpening device 50 includes a hollow housing 52 for receiving the blades 12, 13 of a pair of scissors 10 (such as the scissors 10 described in relation to FIG. 1); a pair of positioning rollers 54 located within the housing 52 arranged in an opposed relationship to receive the blades 12, 13 of the scissors 10 therebetween when the scissors 10 are inserted into the housing 52; and a pair of sharpener units 56 also located within the housing arranged in an opposed relationship to contact the blades 12, 13 of the scissors 10 therebetween.

The housing 52 is hollow and closed on all sides and a rear end so as to provide a scabbard or enclosure for the scissors 10 to protect the blades 12 and 13 when not in use. The housing 52 includes a hollow main body section 53, an open front end piece 62 and an end cap 68. Each of the end piece 62 and end cap 68 are held into the main body section 53 via lugs 63 and 65 which are received in or behind cooperating formations (recesses 63A and ribs 65A) in the main body section 53. Two cover plates 58 are provided on the sides of the housing 52 which can include indicia and/or graphics on a front surface thereof.

An elongate blade receiving passage 60 is defined within the housing 52, and the scissor blades 12 and 13 are moved into the passage 60 through the open front end piece 62 of the housing 52. If desired, at least part of one of the side walls or end walls of the housing 52 may be movable or removable to permit access to the interior for the purpose of maintenance such as cleaning and repair or replacement of the positioning rollers 54 and/or sharpener units 56.

Figure 3:
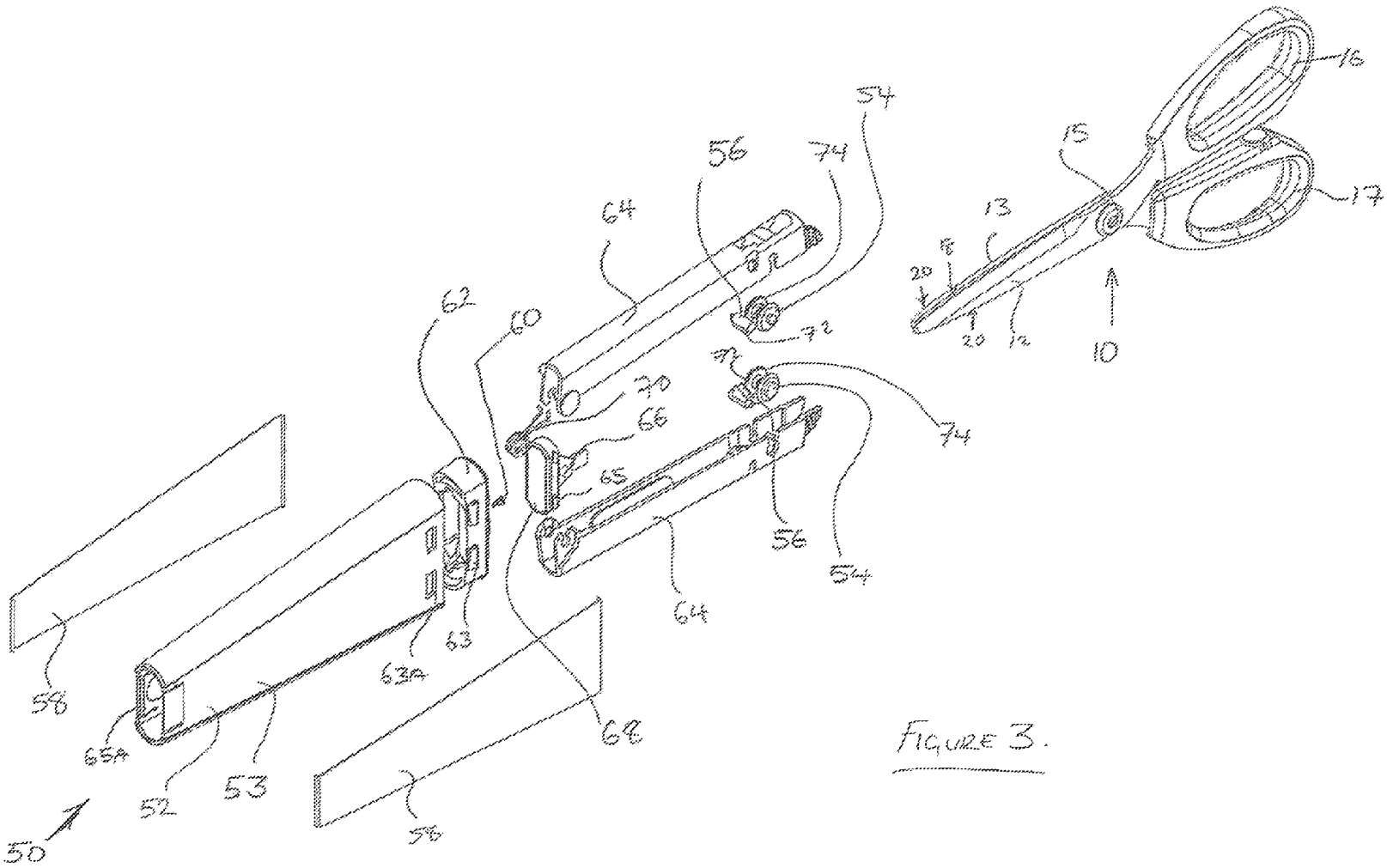
FIG. 3 is an exploded perspective view of the scabbard shown in FIG. 2.

Each positioning roller 54 and sharpener unit 56 are pivotably mounted on one of two elongate carrier members 64 arranged within the housing 52. The carrier members 64 are connected at their rear ends through a pivot 66 (formed on the end cap 68 of the housing 52) which allows limited pivotable movement of each carrier member 64 together and apart within the housing 52. The carrier members 64 are biased (as shown in FIG. 3) by coil spring 70 fixed about the pivot 66. The coil spring 70 acts on each carrier member 64 to urge those members 64 into a closed position so that the positioning rollers 54 engage the scissors 10 when inserted into the housing 52. Each positioning roller 54 and sharpener unit 56 are located at the distal end of the respective carrier member 64 to position these units adjacent the open front end piece 62 of the housing 52. This allows the sharpener units 56 to sharpen the whole cutting edge 18 of the blades of the scissors 10 when in use. The sharpener units 56 are also positioned outwardly of the positioning rollers 54 relative to the center line between the carrier members 64. This puts each sharpening unit 56 in a position in which they can only contact and remove material from the cutting edge 18 of a blade 12, 13 in use when the blades 12, 13 of the scissors 10 are moved to the sharpening condition such as is shown in FIG. 5. In this regard, the offset distance between the adjacent pairs of positioning roller 54 and sharpener unit 56 must be less than or equal to the distance β which the cutting edge 18 of each blade 12, 13 projects beyond the back edge 20 of the other blade 13, 12 in the sharpening condition.

Each sharpener unit 56 includes a honing or cutting element 72 which treats the cutting edge 18 (FIG. 5) of a blade 12 or 13 as that blade 12 or 13 is moved across the element 72. Each element 72 is of the cutting type such as carbide or similar that removes metal from a blade 12 or 13 to effect sharpening.

Each of the positioning rollers 54 can include an annular channel 74 in which the back edge 20 and/or cutting edge 18 of the blades 12, 13 are received and engage with when the blades 12, 13 of the scissors 10 are inserted and withdrawn from the housing 52.

Each sharpener unit 56 is pivotally mounted in the respective carrier member 64 to enable it to sharpen a scissor blade 12, 13 during movement of the scissors 10 both in and out of the housing 52. More usually, the scissors 10 are sharpened when withdrawing the scissors 10 from the housing 52. In this respect, a user would squeeze the handles 16, 17 of the scissors 10 to move the blades from the closed condition as shown in FIG. 4 to the sharpening condition shown in FIG. 5. The cutting edges 18 of the blades 12, 13 of scissors 10 are therefore forced into contact with the cutting element 72 of the sharpener unit 56 and the cutting edge can be sharpened by the sharpener unit 56 while the blades 12, 13 are withdrawn from the housing 52. If the handles 16, 17 are not squeezed during withdrawal, the cutting edges 18 of the blades 12, 13 of scissors 10 do not contact with the cutting element 72 of the sharpener unit 56 as shown in FIG. 4. The blades 12, 13 are consequently withdrawn from the housing 52 with no sharpening action.

Figure 6:
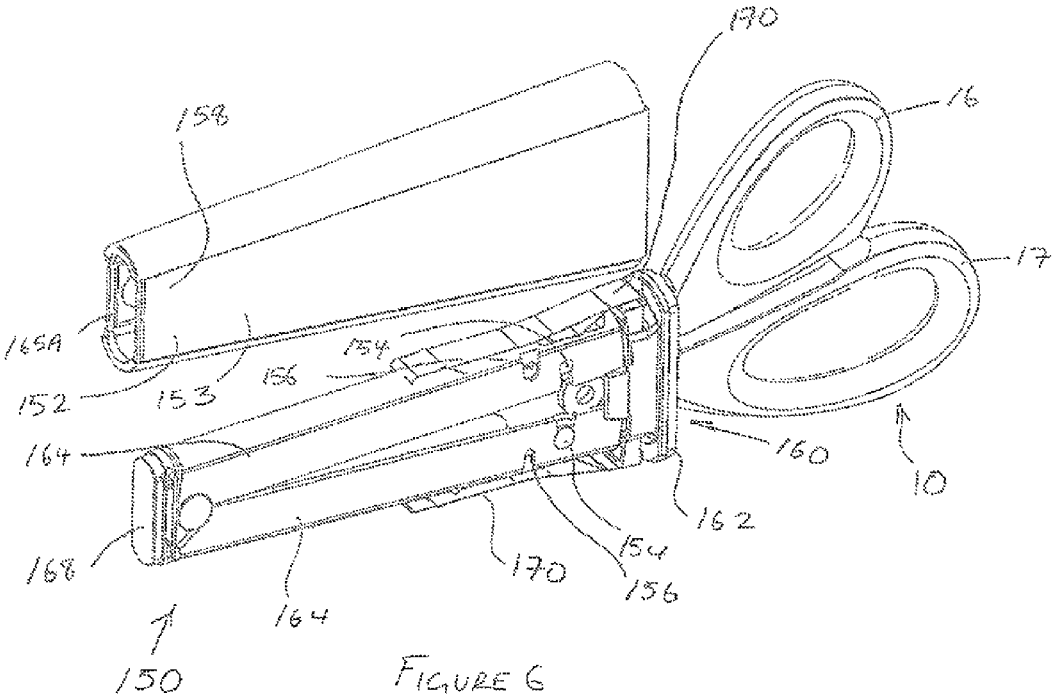
FIG. 6 is a perspective view of the scissors shown in FIG. 1 held in a scabbard that includes a sharpening device according to another preferred embodiment of the present invention. The scabbard is shown with a part of the housing removed.

A sharpening device 150 according to another embodiment of the present invention is shown in FIG. 6. The sharpening device 150 shown in FIG. 6 has a similar construction to the sharpening device 50 shown in FIGS. 2 to 5. Accordingly, like parts in the sharpening device 150 shown in FIG. 6 have been given the same reference numerals as like parts in the sharpening device 50 shown in FIGS. 2 to 5 plus 100. It is to be understood that the above description of the sharpening device 50 equally applies to the sharpening device 150 with the exception of the biasing means that urges the carrier members 164 together into a closed position so that the positioning rollers 154 engage the scissors 10 when inserted into the housing 152. In this embodiment of the sharpening device 150, the carrier members 164 are biased by two leaf springs 170 fixed to an outer side of each carrier members 164 and the open front end piece 162. The leaf springs 170 act between an inner wall of the housing 152 and the outer side of each carrier members 164 to bias the carrier members 164 together.

Those skilled in the art will appreciate that the invention described herein is susceptible to variations and modifications other than those specifically described. It is understood that the invention includes all such variations and modifications which fall within the spirit and scope of the present invention.

Future patent applications may be filed in Australia or overseas on the basis of or claiming priority from the present application. It is to be understood that the following provisional claims are provided by way of example only, and are not intended to limit the scope of what may be claimed in any such future application. Features may be added to or omitted from the provisional claims at a later date so as to further define or re-define the invention or inventions.

The invention claimed is:

1. Scissors including:

two blades, each blade having a cutting edge and a back edge which respectively form opposite longitudinal edges of the blade;

a pivot connecting the two blades for relative movement of the blades between an open condition in which the cutting edges of the blades are apart; a closed condition in which the blades are substantially adjacent and the back edge of each blade projects beyond the cutting edge of the other blade; and a sharpening condition in which the cutting edge of each of the blades can be sharpened; and a biasing means for biasing the blades away from the sharpening condition towards the closed condition and/or the open condition the cutting edges of the blades face outwardly away from each other and are disposed on opposite sides of a longitudinal axis of the scissors, and wherein, wherein in the sharpening condition the cutting edge of each blade projects beyond the back edge of the other blade.

2. The scissors according to claim 1, wherein the biasing means biases the blades away from the sharpening condition to the closed condition.

3. The scissors according to claim 1, wherein the biasing means is located in or proximate the pivot.

4. The scissors according to claim 1, wherein the biasing means is secured to the pivot so as to act between the two blades.

5. The scissors according to claim 1, wherein the pivot is fixedly secured into a first of the blades so as to allow the biasing means to act between the pivot and a second of the blades.

6. The scissors according to claim 5, wherein the pivot includes a pivot shaft laterally connecting the blades, the pivot shaft including a first end having a keyed fit with the first blade and a second end configured to allow the second blade to pivot about the shaft relative to the first blade.

7. The scissors according to claim 6, wherein the second end of the shaft includes a slot in which a first section of the biasing means is secured and the second blade includes at least one adjoining recess in which a second section of the biasing means is secured.

8. The scissors according to claim 1, wherein the biasing means is a leaf spring.

9. The scissors according to claim 1, wherein the biasing means is a helical torsion spring.

10. The scissors according to claim 1, wherein each blade includes a handle which allows a user to actuate the blades between the open, closed and sharpening conditions, the handles being configured to be spaced apart in the open and closed condition and, when in the sharpening condition to be abutting or closer together than in either of the open or closed conditions.

11. In combination, the scissors according to claim 1 and a sharpening device including:

a hollow housing for receiving the blades of the scissors;

a pair of positioning units within the housing arranged in an opposed relationship to receive the blades therebetween when the scissors are inserted into the housing; and a pair of sharpener units located within the housing arranged in an opposed relationship to contact therebetween the cutting edge of each blade projecting beyond and proud of the back edge of the other blade.

12. Scissors including:

two blades, each blade having a cutting edge and a back edge which respectively form opposite longitudinal edges of the blade;

a pivot connecting the two blades for relative movement of the blades between an open condition in which the cutting edges of the blades are apart; a closed condition in which the blades are substantially adjacent and the back edge of each blade projects beyond the cutting edge of the other blade; and a sharpening condition in which the cutting edge of each of the blades can be sharpened; and a biasing means for biasing the blades away from the sharpening condition towards the closed condition and/or the open condition, wherein the pivot includes a pivot shaft laterally connecting the blades, the pivot shaft including a first end having a keyed fit with the first blade and a second end configured to allow the second blade to pivot about the shaft relative to the first blade.

13. The scissors according to claim 12, wherein the second end of the shaft includes a slot in which a first section of the biasing means is secured and the second blade includes at least one adjoining recess in which a second section of the biasing means is secured.

* * * * *